US005884975A

United States Patent [19]

Su

[11] Patent Number: 5,884,975

[45] Date of Patent: Mar. 23, 1999

[54] CHAIR ARMREST

[76] Inventor: Wen-Fa Su, No. 1-2, Hsia Chuang Tzu, Ko Li Village, Tung Shan Hsiang, Tainan Hsien, Taiwan

[21] Appl. No.: 30,547

[22] Filed: Feb. 26, 1998

[51] Int. Cl.[6] ..... A47C 7/54

[52] U.S. Cl. ..... 297/411.35; 297/411.36; 297/411.37; 297/411.38

[58] Field of Search ..... 297/411.35, 411.36, 297/411.38, 411.2, 411.37; 248/118, 118.3

[56] References Cited

U.S. PATENT DOCUMENTS 4,244,623 1/1981 Hall et al. .
5,382,079 1/1995 Wilson et al. .
5,484,187 1/1996 Doerner et al. .
5,590,934 1/1997 Gibbs .
5,599,067 2/1997 Schuelke et al. .
5,655,814 8/1997 Gibbs .
5,743,595 4/1998 Kirdulis .

*Primary Examiner*—Milton Nelson, Jr.
*Attorney, Agent, or Firm*—Rosenberg, Klein & Bilker

[57] ABSTRACT

A chair armrest includes a vertical adjuster and an angle adjuster combined with the vertical adjuster for adjusting its height, and its angle to the right, the left, the backward and the forward direction so as to suit to different body size of different users and different occasions.

15 Claims, 12 Drawing Sheets

CHAIR ARMREST

BACKGROUND OF THE INVENTION

This invention relates to a chair armrest, particularly to one possible to be adjusted in its height, and its angle to the right, the left, the backward, and forward direction so as to suit body size of a user, who can sit comfortably on a chair.

Modern society forces people work busily and tensely, and the design of chairs directly concerns daily life people. Above all, the curvature of a backrest and a seat is the essential of study for makers, who always make effort to produce a most comfortable chair having a curvature to suit to body structure. Except the curvature of a backrest and a seat, armrests at two sides of a chair have also large impact to comfortableness for sitting. Common armrests of chairs are immovable, impossible to suit to every body, as each person has different body size.

SUMMARY OF THE INVENTION

A main purpose of the invention is to offer a chair armrest possible to be adjusted in its height and its angle to the right, the left, the backward and the forward direction to suit to any person to give comfortableness in sitting on a chair.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
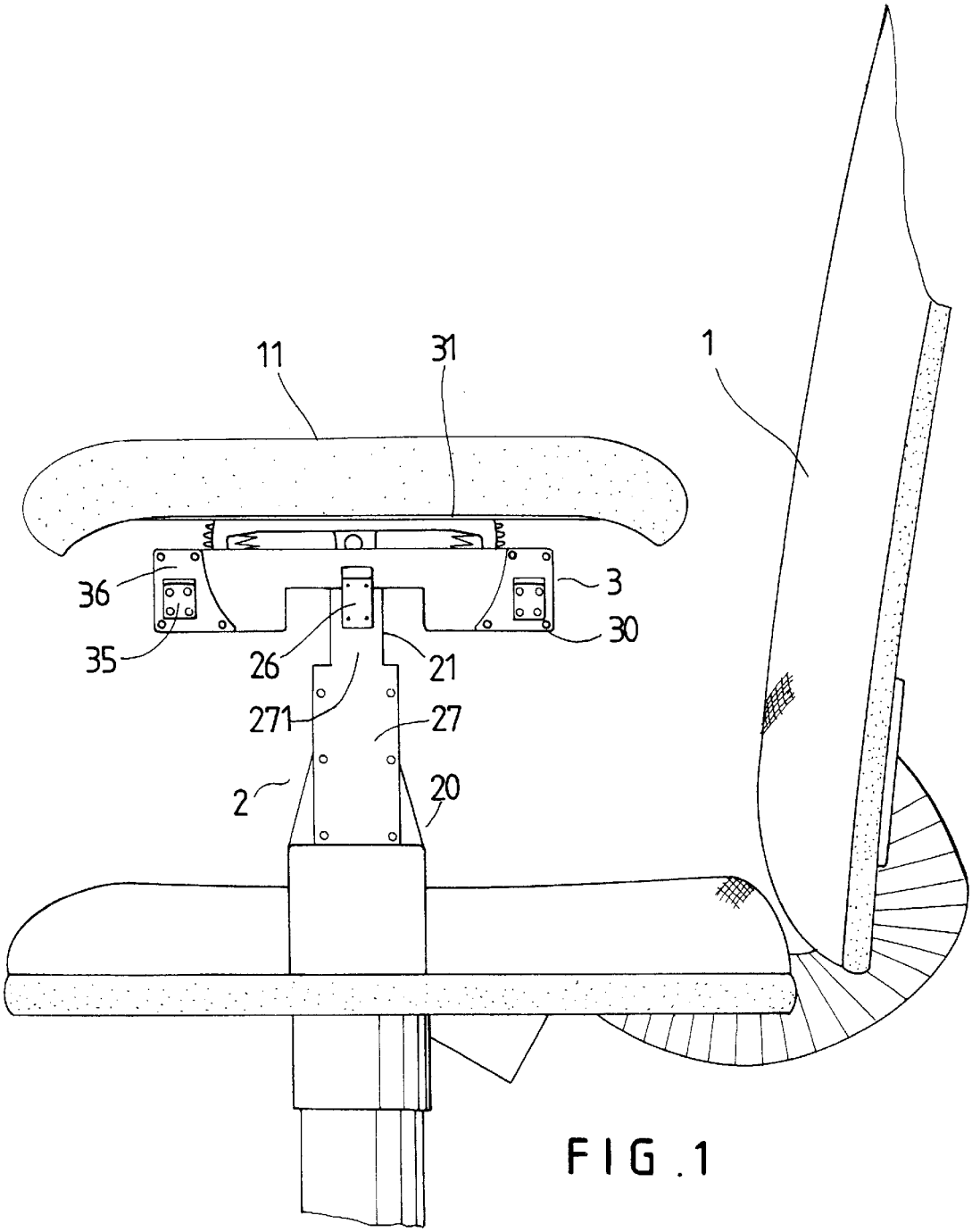
FIG. 1 is a side view of a chair armrest of the present invention.
Figure 2:
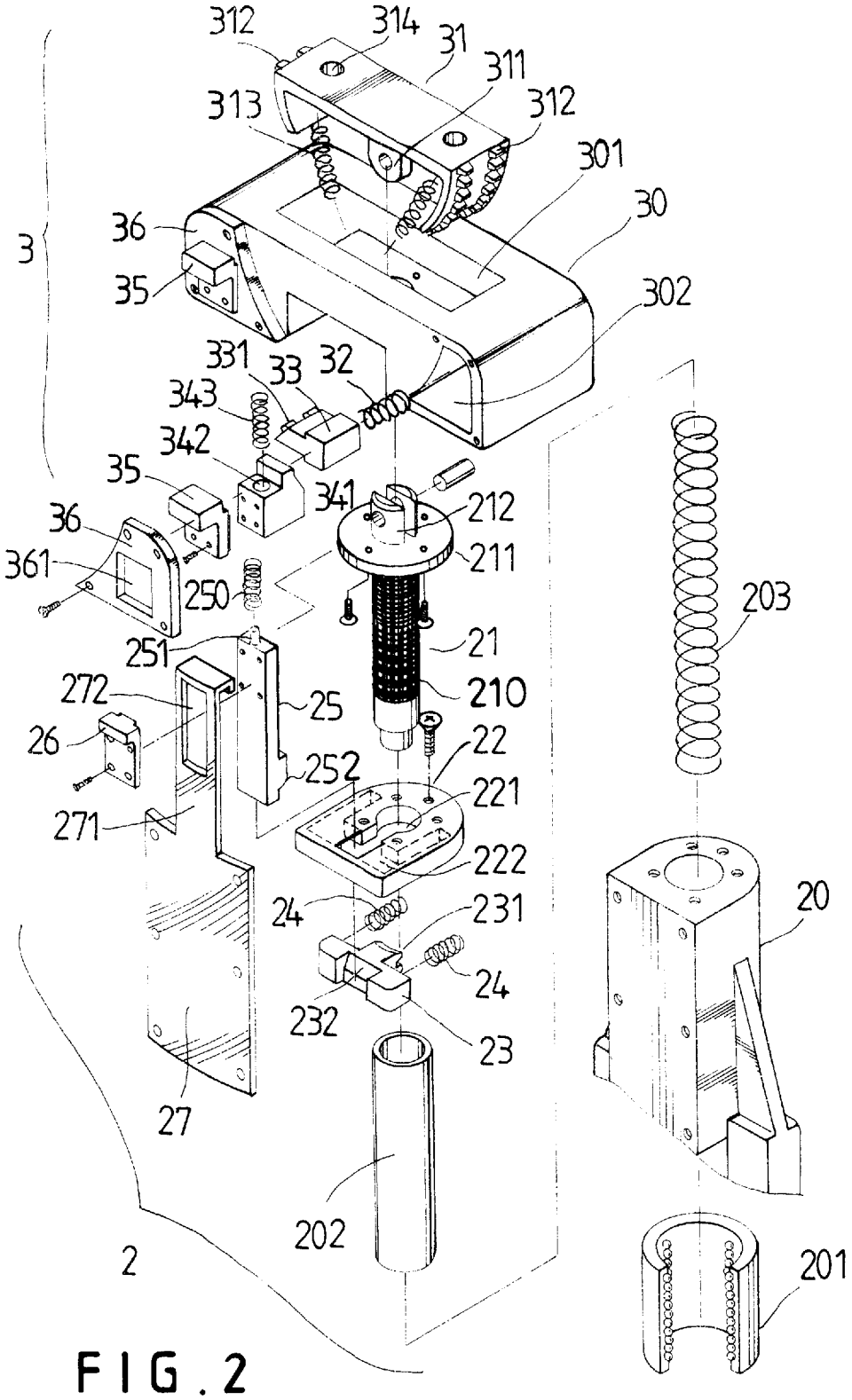
FIG. 2 is an exploded perspective view of the chair armrest of the present invention.

A first embodiment of a chair armrest in the present invention, as shown in FIG. 1, includes an armrest 11 to be fixed respectively on two sides of a chair 1, a vertical adjuster 2 and an angle adjuster 3 combined under the armrest 11.

The vertical adjuster 2 consists of a base 20, an adjust rod 21, a position disc 22, a main locking means 23, a coil spring 24, a side locking means 25, a push block 26 and a cover 27.

The base 20 has a tube 202 fitted in a center hole, a bearing 201 fitting around the tube 202, and a coil spring 203 fitting in the tube 202.

The adjust rod 21 has a plurality of tooth discs 210 formed around its body spaced apart with annular grooves 2100, a plurality of teeth 2101 extending laterally from each tooth disc 2210 and spaced apart from one another, a circular disc 211 formed in an upper end, and a pivotal portion 212 formed on a center portion of the circular disc 211.

The position disc 22 has a preset shape, a screwshaped hole 221, and a U-shaped groove 222 formed in a lower side and communicating with the hole 221.

Figure 3:
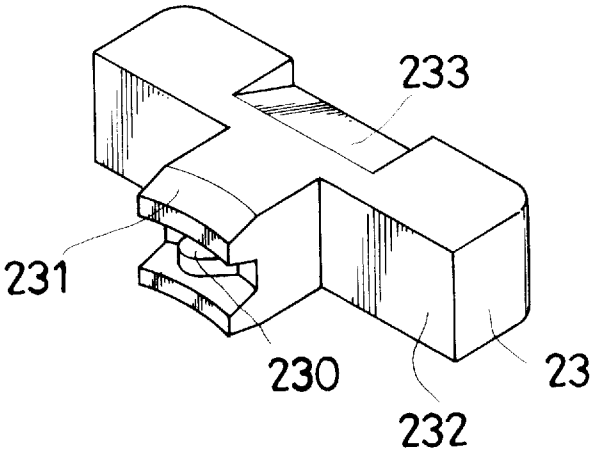
FIG. 3 is a perspective view of a locking means of the chair armrest of the present invention.

The main locking means 23 is shaped nearly as a T, having two sidewise teeth 231, a middle tooth 230 formed between the two teeth 231, a flat surface 232 formed at two sides of the teeth 231 for a spring 24 to rest on, and a sloped surface 233 behind the teeth 231, as shown in FIG. 3.

The side locking means 25 is shaped as a rectangular plate, having a stud 251 on an upper end surface for securing a coil spring 250, and a sloped surface 252 formed in a lower end. A L-shaped push block 26 is provided to rest on an outer side of the side locking means 25.

The cover 27 is made of a thin plate, having a narrow upper position portion 271, and a rectangular hole 272 formed in the upper position portion 271 for the side locking means 25 to fit and move therein.

The angle adjuster 3 consists of an armrest base 30, a swingable base 31, a coil spring 32, a toothed block 33, a movable block 34, a push block 35, and a cap 36.

The armrest base 30 has an upper chamber 301 formed in an center portion of an upper side, a side chamber 302 respectively formed laterally in two opposite sides and communicating with the upper chamber 301.

The swingable base 31 is fitted in the upper chamber 301 of the armrest base 30, having a pivotal means 311 formed under a middle section of a flat plate portion, a curved-down-and-inward wall respectively extending down from the two opposite sides of the flat plate portion, plural teeth 312 formed on each side wall, and two coil springs 313 provided to be located oppositely under the flat plate portion, and the flat plate portion provided with two holes 314 spaced apart.

The coil spring 32 is contained in the side chamber 302 urged by the toothed block 33.

The toothed block 33 has two teeth 331 on a side and a sloped surface on another side to contact with a sloped surface 341 of the movable block 34.

The movable block 34 has the sloped surface 341 to contact with the toothed block 33, a hole 342 bored in an upper side, a coil spring 343 fitted in the hole 342, and contacting a push block 35 at an outer side. The cap 36 has a hole 361 for the push block 35 to fit therein and covering each of the two side chambers 302.

Figure 4:
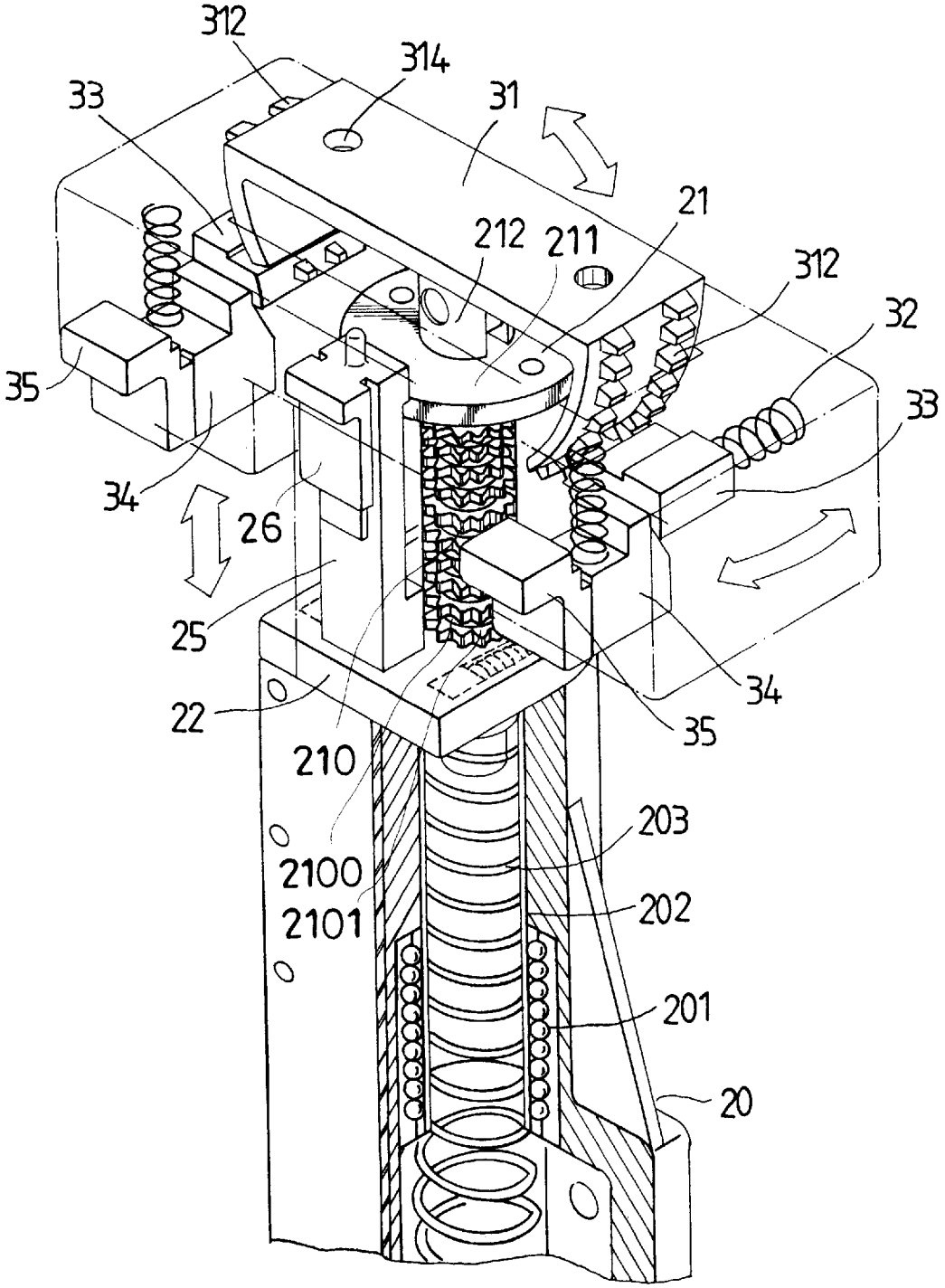
FIG. 4 is a perspective view of the chair armrest of the present invention.

In assembling, referring to FIG. 4, firstly, the main locking means 23 and the coil spring 24 of the vertical adjuster 2 are inserted in the U-shaped groove 222 of the position disc 22, fixing the position disc 22 on an upper side of the base 20, with the adjust rod 21 fitting in the hole 221. And the upper end of the main locking block 23 contacts the lower end of the side locking means 25. Then the cover 27 is covered fixedly on the vertical outer side of the base 20, with the position portion 271 contacting the side locking means 25 to force the push block 26 protrude in the hole 272. At last, the pivot 311 of the rotatable base 31 is combined pivotally with the pivotal means 212 of the adjust rod 21 so that the armrest 11 may be adjusted and locked at one of many positions in different angles.

Figure 5:
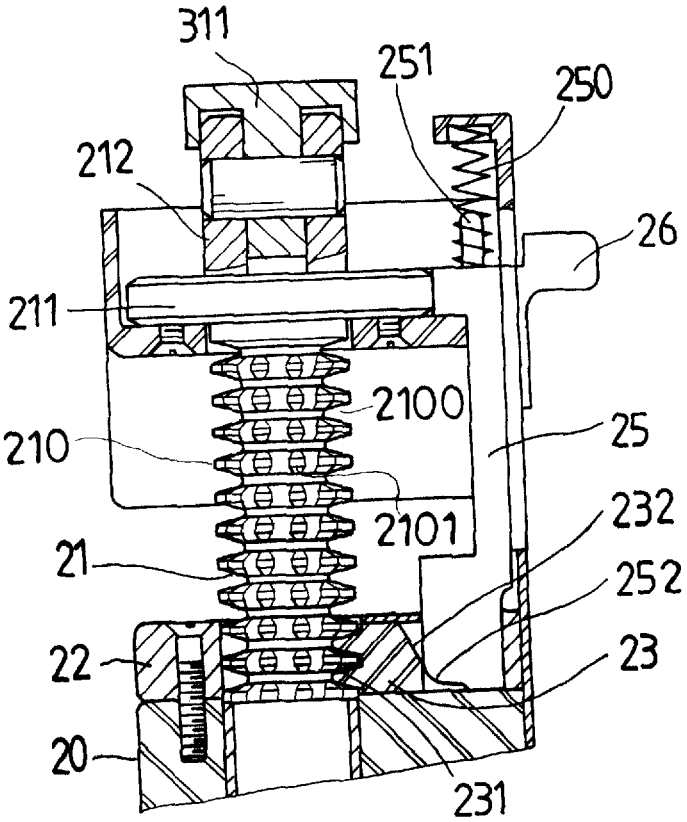
FIG. 5 is a cross-sectional view of a vertical adjuster of the chair armrest of the present invention.
Figure 6:
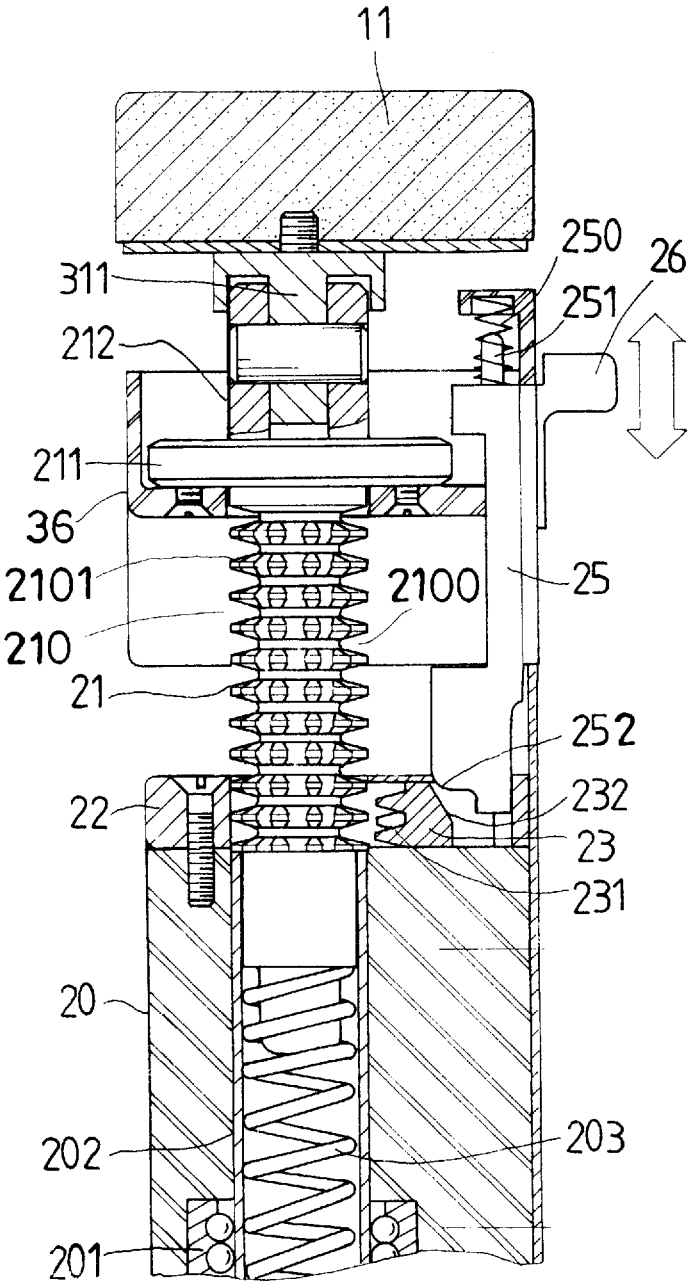
FIG. 6 is another cross-sectional view of the vertical adjuster of the chair armrest of the present invention.

When the armrest 11 is wanted to be adjusted in the vertical and the right and the left direction, a user may push the push block 26 vertically to move the side locking means 25 move up and down, as shown in FIGS. 5 and 6, with the push face 252 also moving up to separate the main locking means 23 from the adjust rod 21, with the coil spring 250 on the stud 251 compressed, freeing the armrest 1. Then the user can operate the adjust rod 21 to move the armrest 11 right and left. Then the main locking means 23 and the adjust rod 21 are pushed up by the coil spring 203 of the base 20 to change vertically the position of the adjust rod 21, and then the user releases the push block 26, permitting the coil spring 250 push down elastically the side locking means 25 so as to let the gear disc 210 engage the tooth 231 again, and the push face 252 pushes the sloped surface 232 of the main locking means 23, with the teeth 231 engaging the annular groove 2100 of the adjust rod 21, and with the middle tooth 230 of the main locking means 23 engaging one of the teeth 2101.

Figure 8:
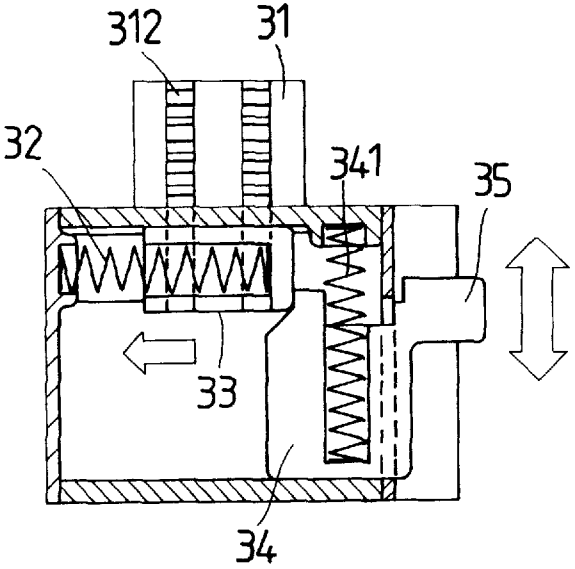
FIG. 8 is a cross-sectional view of the angle adjuster of the chair armrest of the present invention, showing it being adjusted.
Figure 7:
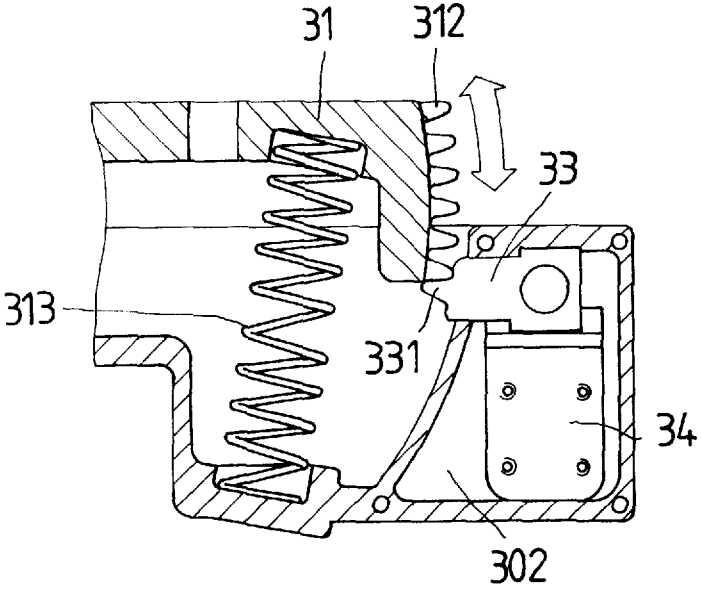
FIG. 7 is a cross-sectional view of an angle adjuster of the chair armrest of the present invention.
Figure 9:
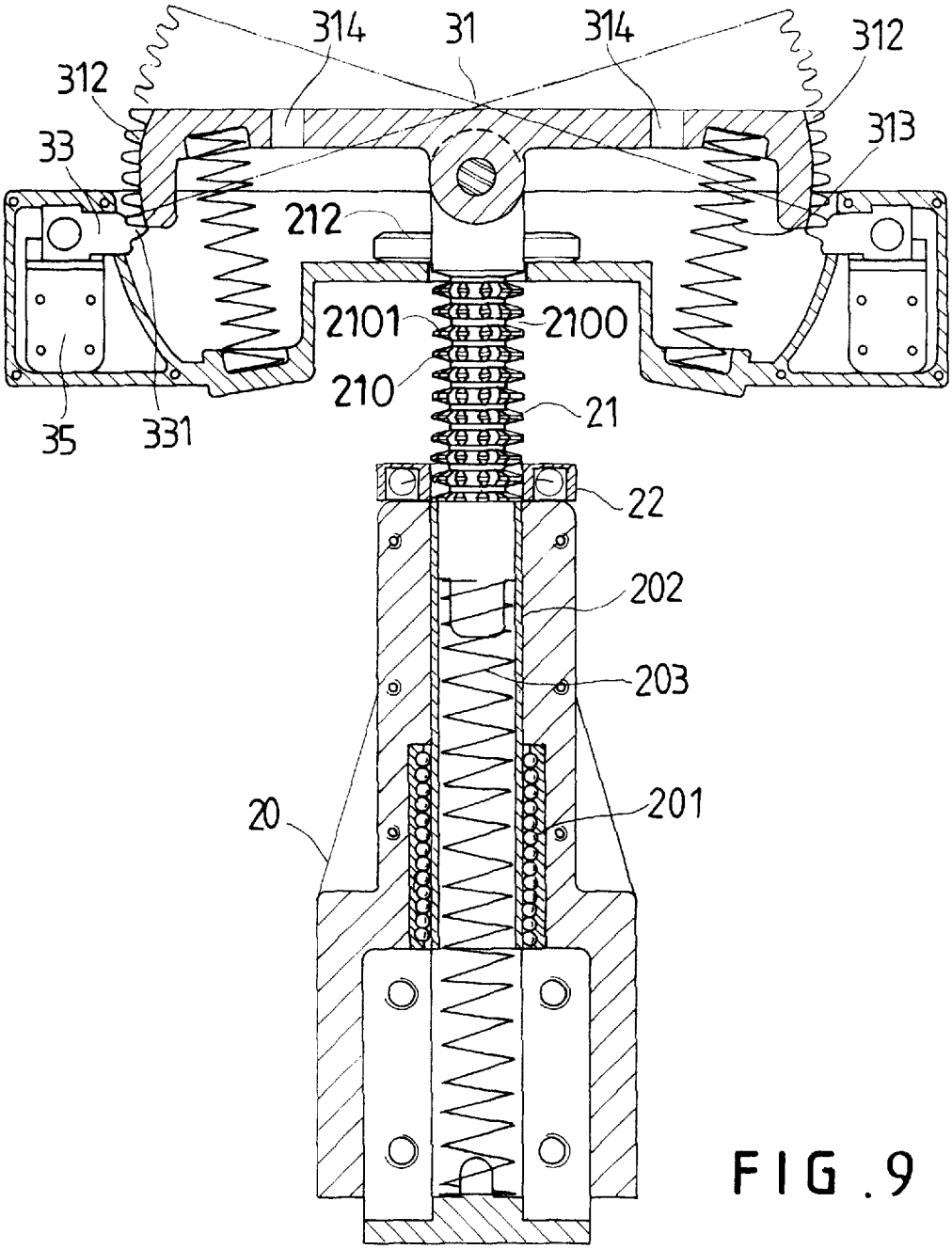
FIG. 9 is another cross-sectional view of the angle adjuster of the chair armrest in the present invention, showing it to be adjusted of another way.

If a user wants to adjust the angle of the armrest 11, referring to FIGS. 7 and 8, he/she pushes up either of the two push blocks 35, which then pushes up the movable block 34, with the sloped surface 341 engaging the toothed member 33 to separate the two teeth 331 from the two teeth 312 of the swingable base 31. Then the user can adjust the angle of the armrest 11 and release the push block 35 after the angle of the armrest 11 is adjusted, with the coil spring 343 recovering its elasticity to push down the movable block 34. Consequently, the sloped surface 341 no longer engage the toothed member 33, with the coil spring 32 recover its elasticity to push up the toothed member to its normal place, and with the teeth 331 engaging the teeth 312 again. When the angle of the armrest 11 is moved to the largest, only the teeth 312 of one of the two sides of the swingable base 31 engage the teeth 331 of the toothed member 33. If the angle of the armrest 11 is needed to be adjusted, then the push block 35 of the other side is pressed to make the rotatable base 31 rotate to the other side, as shown in FIG. 9.

Figure 10:
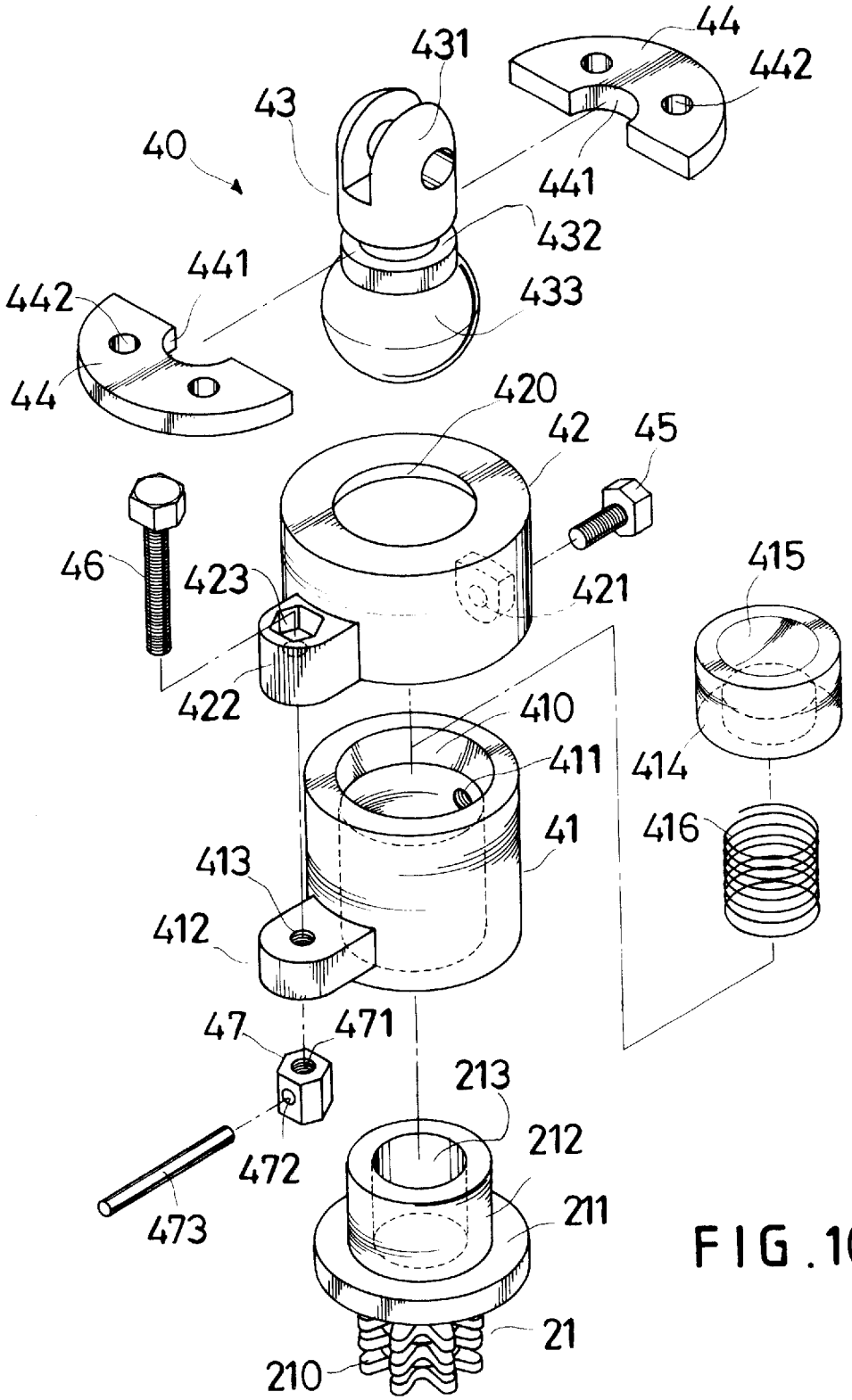
FIG. 10 is an exploded perspective view of a second embodiment of a chair armrest of the present invention.

A second embodiment of a chair armrest in the present invention, as shown in FIG. 10, has the same structure except an angle adjuster 40 taking place of the angle adjuster 3 between the armrest base 30 and the adjust rod 21 in the first embodiment.

The angle adjuster 40 includes an upper cylinder 42, a lower cylinder 41, a movable joint 43, a position disc 44, a bolt 45, an adjust bolt 46 and a position nut 47.

The lower cylinder 41 has a center through hole, an annular curved surface 410 in an upper end of the center hole, a threaded hole 411 in an outer surface, an ear 412 projecting out from an opposite location of the threaded hole 411 and provided with a threaded hole 413. An auxiliary cylinder 414 fits in the center hole of the lower cylinder 41 from under, having an annular curved surface 415 in an upper portion, and a spring 416 fitting in a lower portion of a center hole.

The upper cylinder 42 is formed integral and of an inverted U-shape, fitting around an upper portion of the lower cylinder 41, an upper end having an annular curved surface 420, a threaded hole 421 corresponding to the threaded hole 411 of the lower cylinder 41, an ear 422 with a threaded hole 423 extending out from a lower outer surface and facing the ear 412 of the lower cylinder 41.

The movable joint 43 has an upper pivot portion 431, an annular groove 432 formed under the movable joint 431 and a lower spherical glossy portion 433 formed under the annular groove 432.

The position disc 44 is formed with two semicircular discs each provided with a semicircular notch 441 and some holes 442.

The bolt 45 screws with the hole 421 of the upper cylinder 42 and the hole 411 of the lower cylinder to combine securely the upper and the lower cylinder 42 and 41 together.

The adjust bolt 46 screws with the threaded hole 423 of the ear 422 of the upper cylinder 42 and the threaded hole 413 of the ear 412 of the lower cylinder 41 and the position nut 47, which has a center threaded hole 471 for the adjust bolt 46 to screw with, and a limit hole 472 in a vertical side for an adjust rod 473 to fit therein for rotating the position nut 47 in adjusting.

Figure 11:
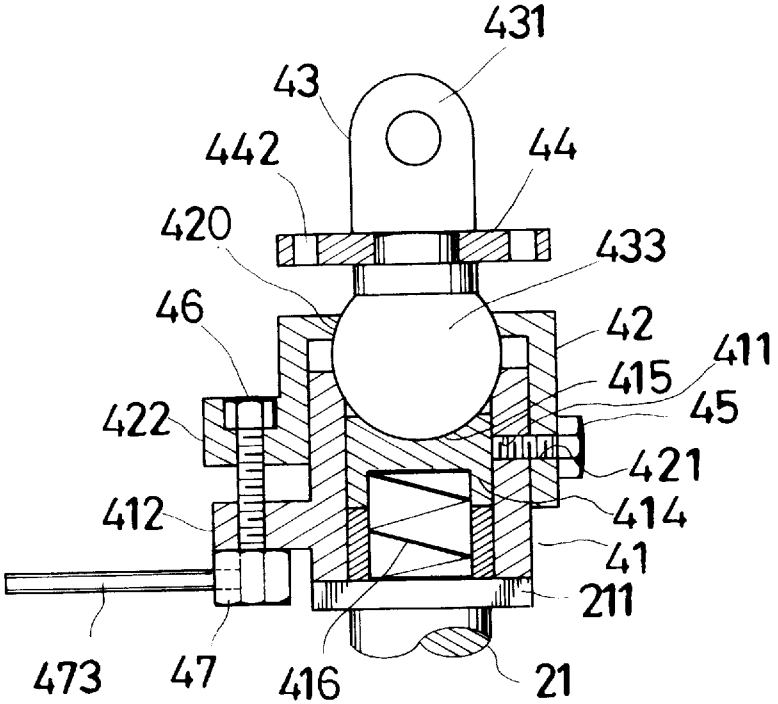
FIG. 11 is a cross-sectional view of the second embodiment of a chair armrest of the present invention.

In assembling the angle adjuster 40 of the second embodiment of a chair armrest, referring to FIG. 11, firstly, the lower cylinder 41 is fitted around a pivotal means 212 with a center hole 213 provided on a circular disc 211 of the adjust rod 21, with the coil spring 416 fitted in the center hole 213. Then the movable joint 43 is placed on the pivotal means 212, with the lower spherical portion 433 just fitting around the upper annular curved surface 410 of the lower cylinder 41. Then the upper cylinder 42 is overlaid on the movable joint 43 and the lower cylinder 41, with the sperical portion 433 also contacting the annular curved surface 420 of the upper cylinder 42, the annular curved surface 410 and the annular curved surface 415 of the auxiliary cylinder 414 at the same time. Then the threaded holes 421, 411 of the upper and the lower cylinder 42 and 41 are made to face each other and screwed with the bolt 45 tightly and the adjust bolt 46 is made to screw with the threaded holes 423, 413 and 471 of the upper and the lower cylinder 42, 41 and the position nut 47, with the pivotal portion 431 pivotally connected with the bottom of the armrest base 30, and with the two position half discs 44 fitted in the annular groove 432 of the movable joint 43 and fixed tightly with the lower side of the armrest base 30 with screws passing through the holes 442.

Figure 12:
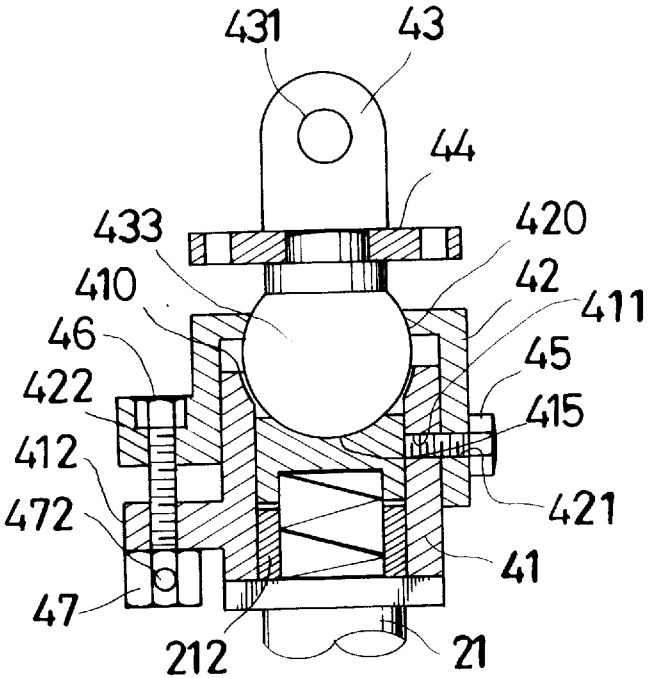
FIG. 12 is a cross-sectional view of the second embodiment of a chair armrest of the present invention.
Figure 13:
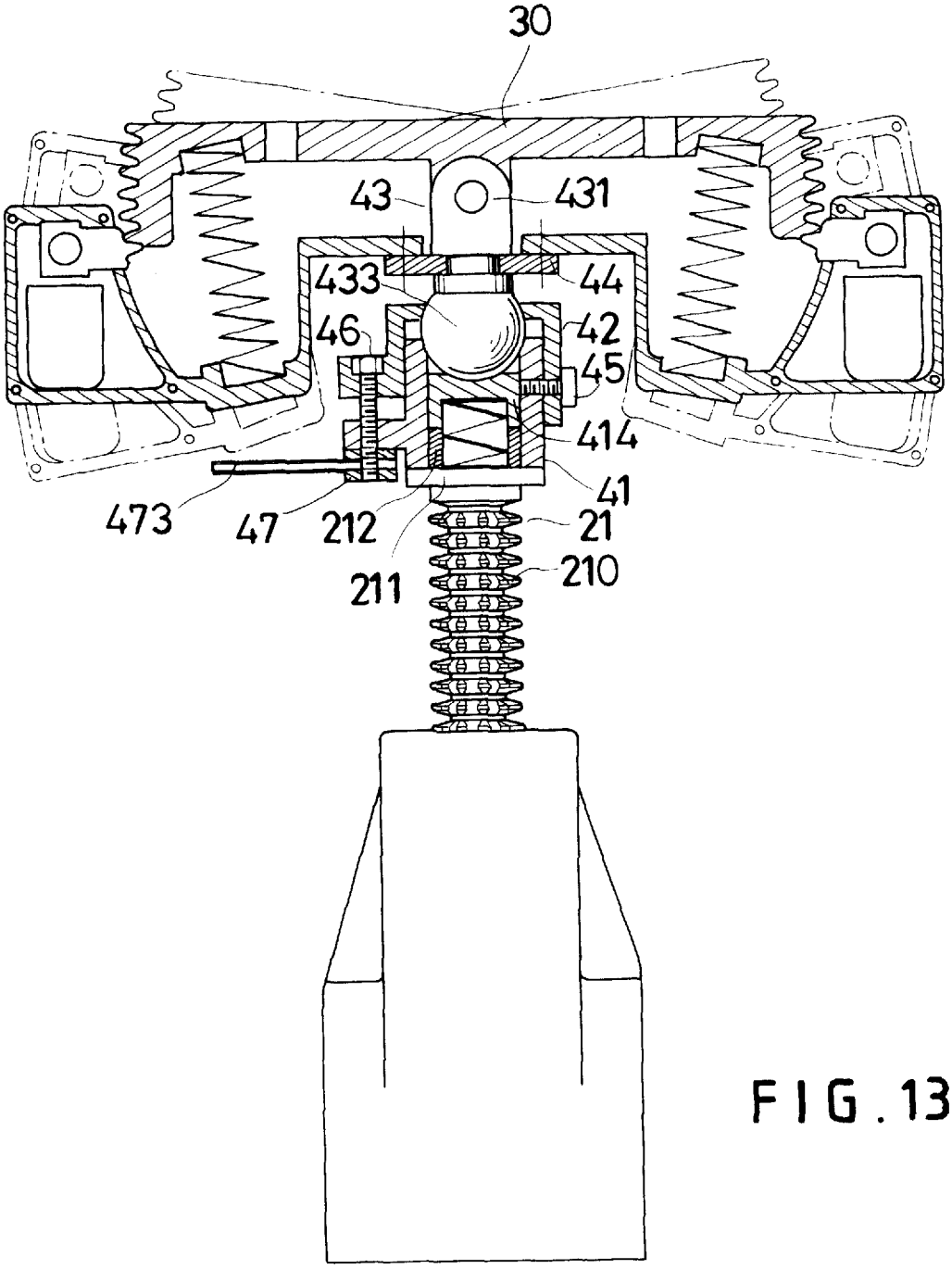
FIG. 13 is a side cross-sectional view of the second embodiment of a chair armrest in the present invention, showing it being handled of adjusting its angle; and, FIG. 14 is a front cross-sectional view of the second embodiment of a chair armrest of the present invention, showing it being handled in adjusting its angle.
Figure 14:
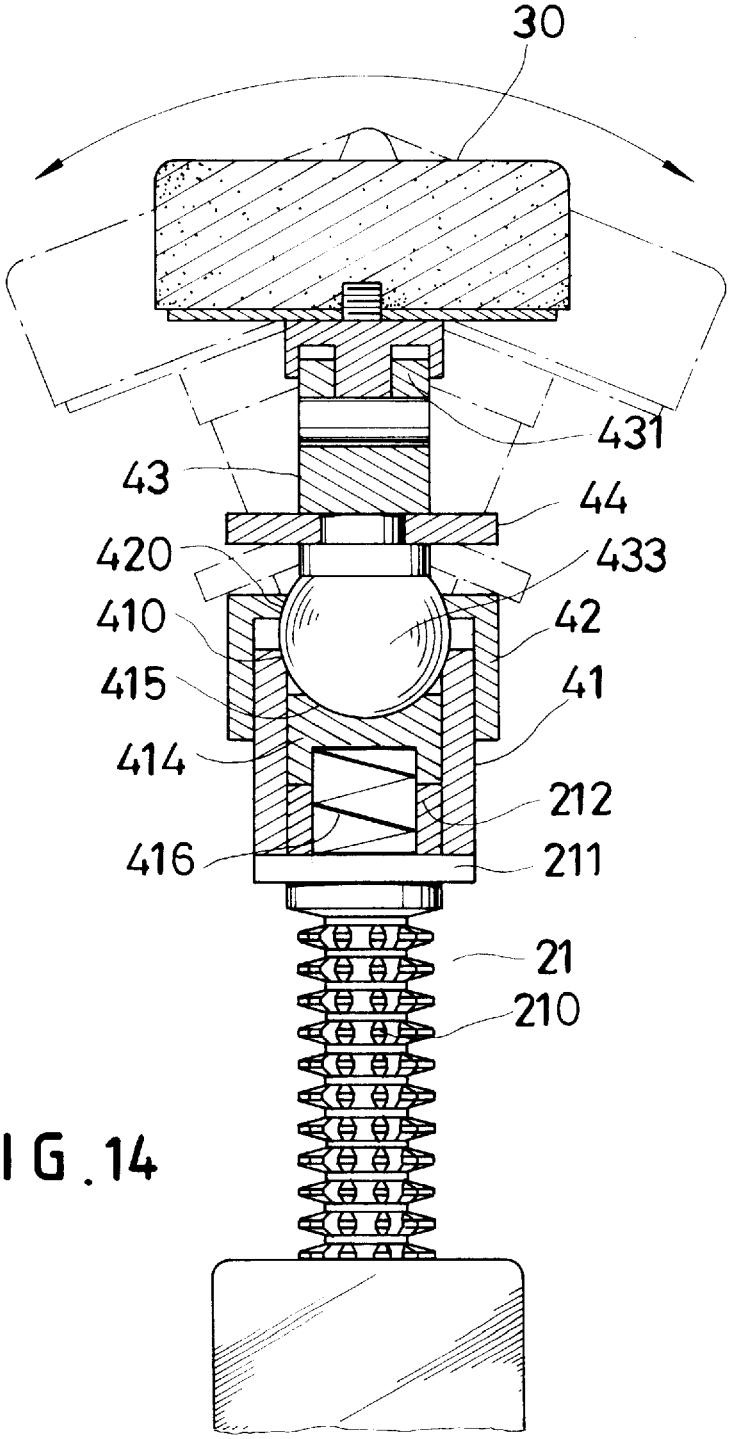

In using the second embodiment of the chair armrest, referring to FIGS. 11 and 12, a user rotates the nut 47 to loosen from the adjust rod 473, permitting the spherical portion 433 become loose between the upper and the lower cylinder 42 and 41. Then the user adjusts the angle of the armrest 30 forward, backward, right and left according to user's own need. Especially, the angle to the right and the left is easily adjusted by means of the spherical portion 433 of the movable joint 43, as shown in FIG. 13, permitting the armrest 30 adjusted minutely in every direction so as to suit to users having different body size.

While the preferred embodiments of the invention have been described above, it will be recognized and understood that various modifications may be made therein and the appended claims are intended to cover all such modifications which may fall within the spirit and scope of the invention.

What is claimed is:

1. A system for adjustably supporting an armrest comprising:

(a) a vertical adjuster including:

(1) an adjust rod assembly including a disc member formed with opposing upper and lower sides, said adjust rod assembly including a pivot section extending from said disc member upper side and a rod section extending from said disc member lower side, said rod section having defined thereon a plurality of axially aligned gear disc segments, adjacent ones of said gear disc segments being spaced one from the other by an annular gap, each of said gear disc segments having a plurality of teeth formed peripherally thereon;

(2) a base assembly supportingly engaging said rod section of said adjust rod assembly in a resiliently biased manner;

(3) a position disc having a lower portion coupled to said adjust rod assembly, said position disc having an opening of predetermined contour formed therethrough and a recess formed in said lower portion, said recess communicating with said opening;

(4) a main locking assembly displaceably received in said recess of said position disc to engage in releasably locked manner at least one of said gear disc segments of said adjust rod assembly rod section, said main locking assembly including a main block member having opposed front and back portions, said back portion having formed thereon a pair of outer teeth and a middle tooth disposed therebetween, said front portion having a sloped face formed therein;

(5) a side locking assembly passed displaceably through said opening of said position disc, said side locking assembly including a longitudinally extended side block member having formed thereon a longitudinally extending stud portion and an outwardly directed sloped surface portion, said sloped surface portion slidably engaging said sloped face of said main block member;

(6) a first push block member coupled to said side locking assembly; and, (b) an angle adjuster coupled to said vertical adjuster, said angle adjuster including:

(1) an armrest base having an upper portion extending between a pair of side portions, said upper portion having a center chamber formed therein, each of said side portions having formed therein a side chamber disposed in open communication with said center chamber;

(2) a swingable base displaceably received in said center chamber of said armrest base, said swingable base having a plate portion extending between a pair of arcuate sidewall portions, said swingable base having a pivot portion projecting from said plate portion and pivotally coupled to said pivot section of said adjust rod assembly of said vertical adjuster, each said sidewall portion having formed thereon a plurality of teeth;

(3) at least one toothed block member displaceably received in one of said side chambers of said armrest base, said toothed block member engaging one of said swingable base sidewall portions in a releasably locked manner;

(4) a second push block member adapted for displacement by a user; and, (5) at least one movable block member coupled to said second push block member and said toothed block member, said movable block member being adapted for displacement responsive to said second push block member displacement, said movable block member having a sloped surface slidably engaging said toothed block member.

2. The system for adjustably supporting an armrest as recited in claim 1 wherein said angle adjuster is disposed between said adjust rod assembly of said vertical adjuster and an armrest.

3. The system for adjustably supporting an armrest as recited in claim 1 wherein said vertical adjuster further includes a pair of spring members disposed between said main locking assembly and said position disc for maintaining a bias force therebetween.

4. The system for adjustably supporting an armrest as recited in claim 3 wherein said vertical adjuster further includes a cover coupled to said base assembly, said cover having a rectangular hole formed therein for open access to said first push block member therethrough.

5. The system for adjustably supporting an armrest as recited in claim 4 wherein said toothed block member is received in said side chamber in resiliently biased manner.

6. The system for adjustably supporting an armrest as recited in claim 5 wherein said angle adjuster further includes a pair of coil spring members disposed between said armrest base and said plate portion of said swingable base, said coil spring members resiliently biasing said swingable base against pivotal displacement in respective predefined directions.

7. A system for adjustably supporting an armrest comprising:

(a) a vertical adjuster including:

(1) an adjust rod assembly including a disc member formed with opposing upper and lower sides, said adjust rod assembly including a pivot section extending from said disc member upper side and a rod section extending from said disc member lower side, said rod section having defined thereon a plurality of axially aligned gear disc segments, adjacent ones of said gear disc segments being spaced one from the other by an annular gap, each of said gear disc segments having a plurality of teeth formed peripherally thereon;

(2) a base assembly supportingly engaging said rod section of said adjust rod assembly in resiliently biased manner;

(3) a position disc having a lower portion coupled to said adjust rod assembly, said position disc having an opening of predetermined contour formed therethrough and a recess formed in said lower portion, said recess communicating with said opening;

(4) a main locking assembly displaceably received in said recess of said position disc to engage in releasably locked manner at least one of said gear disc segments of said adjust rod assembly rod section, said main locking assembly including a main block member having opposed front and back portions, said back portion having formed thereon a pair of outer teeth and a middle tooth disposed therebetween, said front portion having a sloped face formed therein;

(5) a side locking assembly passed displaceably through said opening of said position disc, said side locking assembly including a longitudinally extended side block member having formed thereon a longitudinally extending stud portion and an outwardly directed sloped surface portion, said sloped surface portion slidably engaging said sloped face of said main block member;

(6) a push block member coupled to said side locking assembly; and, (b) an angle adjuster coupled to said adjust rod assembly of said vertical adjuster, said angle adjuster including:

(1) first and second cylinder members coupled one to the other to form a universal joint chamber therebetween; and, (2) a movable joint member having a substantially spherical lower portion adjustably captured within said universal joint chamber formed by said first and second cylinder members.

8. The system for adjustably supporting an armrest as recited in claim 7 wherein said angle adjuster further includes an auxiliary cylinder member disposed within said universal joint chamber.

9. The system for adjustably supporting an armrest as recited in claim 8 wherein said auxiliary cylinder member is disposed in resiliently biased manner against said pivot section of said vertical adjuster adjust rod assembly.

10. The system for adjustably supporting an armrest as recited in claim 7 wherein said angle adjuster is disposed between said adjust rod assembly of said vertical adjuster and an armrest, said movable joint member of said angle adjuster including a pivot portion adapted for pivotal coupling to said armrest, said pivot portion having an annular groove formed thereabout.

11. The system for adjustably supporting an armrest as recited in claim 10 wherein said angle adjuster further includes a pair of semicircular disc members engaging said annular groove of said movable joint member pivot portion.

12. The system for adjustably supporting an armrest as recited in claim 7 wherein said first and second cylinder members respectively include sidewall portions, said sidewall portions being coaxially disposed in at least partially overlapped manner.

13. The system for adjustably supporting an armrest as recited in claim 12 wherein said angle adjuster further includes at least one position bolt passed through said sidewall portions of said first and second cylinder members for the releasable coupling thereof.

14. The system for adjustably supporting an armrest as recited in claim 13 wherein said first and second cylinder members include ear portions protruding respectively from said sidewall portions thereof, said ear portions being disposed in substantially aligned manner.

15. The system for adjustably supporting an armrest as recited in claim 14 wherein said angle adjuster further includes at least one adjusting bolt passed through both said ear portions for reversibly adjusting the tension of said coupling of said first and second cylinder members.

* * * * *